US007379694B2

(12) United States Patent
Takiguchi et al.

(10) Patent No.: US 7,379,694 B2
(45) Date of Patent: May 27, 2008

(54) BELT TRANSFER APPARATUS AND IMAGE FORMING DEVICE

(75) Inventors: Toshiki Takiguchi, Yamatokoriyama (JP); Yoko Sawa, Yamatokoriyama (JP); Hirokazu Yamauchi, Uji (JP); Yoshiaki Masuda, Nara (JP); Yoshie Iwakura, Higashiosaka (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 158 days.

(21) Appl. No.: 10/547,933

(22) PCT Filed: Mar. 10, 2004

(86) PCT No.: PCT/JP2004/003125

§ 371 (c)(1),
(2), (4) Date: Sep. 8, 2005

(87) PCT Pub. No.: WO2004/081675

PCT Pub. Date: Sep. 23, 2004

(65) Prior Publication Data

US 2006/0177248 A1 Aug. 10, 2006

(30) Foreign Application Priority Data

Mar. 11, 2003 (JP) ..... 2003-065706
Apr. 23, 2003 (JP) ..... 2003-118765

(51) Int. Cl.
*G03G 15/20* (2006.01)

(52) U.S. Cl. ..... 399/313; 399/314

(58) Field of Classification Search ..... 399/310, 399/313, 314
See application file for complete search history.

(56) References Cited

U.S. PATENT DOCUMENTS

2001/0031160 A1* 10/2001 Tanaka ..... 399/298

FOREIGN PATENT DOCUMENTS

| | | | |
|---|---|---|---|
| JP | 8-152790 | A | 6/1996 |
| JP | 10-133496 | A | 5/1998 |
| JP | 10-228186 | A | 8/1998 |
| JP | 11-38790 | A | 2/1999 |
| JP | 2003-29538 | A | 1/2003 |

* cited by examiner

*Primary Examiner*—David M. Gray
*Assistant Examiner*—Joseph S. Wong
(74) *Attorney, Agent, or Firm*—Birch, Stewart, Kolasch & Birch, LLP

(57) ABSTRACT

A combined resistance R1=Vt1/I1 (MO) of a transfer belt (61) and a recording sheet obtained when a transfer current I1 (μA) passes through the transfer belt (61) and the recording sheet upon application of a first transfer bias voltage Vt1 (V) to a transfer roller (6*b*) from a high-voltage power source (6*f*) and a combined resistance R2=Vt2/I2 (MO) of the transfer belt (61) and the recording sheet obtained when a transfer current I2 (μA) passes through the transfer belt (61) and the recording sheet upon application of a second transfer bias voltage Vt2 (V) to the transfer roller (6*b*) from the high-voltage power source (6*f*), are established to have the relationship: R2/R1=7 ?(I2)$^{-0.5}$ therebetween.

8 Claims, 19 Drawing Sheets

FIG. 3

| | RESISTANCE | | THICKNESS | PRINTING SPEED |
|---|---|---|---|---|
| BELT | VOLUME RESISTANCE ($\Omega \cdot cm$) | SURFACE RESISTANCE ($\Omega / cm^2$) | (mm) | (SHEETS/MIN) |
| 61d | 2.0E+10 | 5.3E+10 | 0.6 | 65 |
| 61c | 2.2E+10 | 2.8E+10 | 0.5 | 65 |
| 61b | 3.1E+11 | 7.9E+10 | 0.5 | 60 |
| 61a | 2.3E+10 | 5.8E+10 | 0.5 | 70 |

FIG. 4(A)

| | | TRANSFER CURRENT It (μA) | | | | | | | | | | | | | |
|---|---|---|---|---|---|---|---|---|---|---|---|---|---|---|---|
| | | 10 | 15 | 20 | 25 | 30 | 35 | 40 | 45 | 50 | 60 | 70 | 80 | 90 | 100 |
| IMAGE DENSITY ID | | 1.41 | 1.44 | 1.48 | 1.49 | 1.49 | 1.49 | 1.49 | 1.49 | 1.49 | 1.49 | 1.49 | 1.49 | 1.49 | 1.49 |
| TRANSFER VOLTAGE Vt(V) | | 1098 | 1261 | 1365 | 1603 | 1896 | 2045 | 2357 | 2460 | 2530 | 2626 | 3053 | 3221 | 3698 | 4043 |
| IMAGE QUALITY | BK ROUGHNESS | △ | △ | ○ | ○ | ○ | ○ | ○ | ○ | ○ | ○ | ○ | ○ | ○ | ○ |
| | HT ROUGHNESS | △ | △ | △ | ○ | ○ | ○ | ○ | ○ | ○ | ○ | ○ | ○ | ○ | ○ |

FIG. 4(B)

| | | TRANSFER CURRENT It (μA) | | | | | | | | | | | | | |
|---|---|---|---|---|---|---|---|---|---|---|---|---|---|---|---|
| | | 10 | 15 | 20 | 25 | 30 | 35 | 40 | 45 | 50 | 60 | 70 | 80 | 90 | 100 |
| IMAGE DENSITY ID | | 1.26 | 1.38 | 1.38 | 1.40 | 1.41 | 1.42 | 1.41 | 1.42 | 1.41 | 1.41 | 1.40 | 1.39 | 1.39 | 1.40 |
| TRANSFER VOLTAGE Vt(V) | | 1520 | 2073 | 2498 | 2865 | 3197 | 3502 | 3740 | 3945 | 4108 | 4408 | 4458 | 4733 | 5135 | 5322 |
| IMAGE QUALITY | BK ROUGHNESS | × | △ | △ | ○ | ○ | ○ | ○ | ○ | ○ | ○ | ○ | ○ | ○ | ○ |
| | HT ROUGHNESS | ○ | ○ | ○ | ○ | ○ | ○ | ○ | ○ | ○ | ○ | ○ | ○ | ○ | ○ |

FIG. 4(C)

| | | TRANSFER CURRENT It (μA) | | | | | | | | | | | | | |
|---|---|---|---|---|---|---|---|---|---|---|---|---|---|---|---|
| | | 10 | 15 | 20 | 25 | 30 | 35 | 40 | 45 | 50 | 60 | 70 | 80 | 90 | 100 |
| IMAGE DENSITY ID | | 1.13 | 1.29 | 1.36 | 1.37 | 1.37 | 1.37 | 1.33 | 1.35 | 1.34 | 1.34 | 1.32 | 1.32 | 1.31 | 1.31 |
| TRANSFER VOLTAGE Vt(V) | | 199 | 455 | 780 | 897 | 1006 | 1038 | 1149 | 1184 | 1251 | 1361 | 1466 | 1623 | 1698 | 1752 |
| IMAGE QUALITY | BK ROUGHNESS | × | × | ○ | ○ | ○ | ○ | ○ | ○ | ○ | ○ | ○ | ○ | ○ | ○ |
| | HT ROUGHNESS | △ | ○ | ○ | ○ | ○ | ○ | ○ | ○ | ○ | ○ | ○ | ○ | ○ | ○ |

FIG. 4(D)

| | | TRANSFER CURRENT It (μA) | | | | | | | | | | | | | |
|---|---|---|---|---|---|---|---|---|---|---|---|---|---|---|---|
| | | 10 | 15 | 20 | 25 | 30 | 35 | 40 | 45 | 50 | 60 | 70 | 80 | 90 | 100 |
| IMAGE DENSITY ID | | 1.01 | 1.25 | 1.40 | 1.43 | 1.46 | 1.51 | 1.52 | 1.49 | 1.50 | 1.48 | 1.44 | 1.27 | 1.02 | 1.05 |
| TRANSFER VOLTAGE Vt(V) | | 253 | 438 | 665 | 803 | 1043 | 1145 | 1275 | 1495 | 1627 | 1785 | 2005 | 2260 | 2440 | 2715 |
| IMAGE QUALITY | BK ROUGHNESS | △ | △ | △ | △ | △ | ○ | ○ | ○ | ○ | ○ | △ | × | × | × |
| | HT ROUGHNESS | ○ | ○ | ○ | ○ | ○ | ○ | ○ | ○ | ○ | × | × | × | × | × |

(A)

(B)

(C)

(A)

(B)

(C)

(A)

(B)

(C)

BELT TRANSFER APPARATUS AND IMAGE FORMING DEVICE

TECHNICAL FIELD

This invention relates to a belt transfer apparatus for use in electrophotographic image formation by a copier, printer, facsimile apparatus or the like, the belt transfer apparatus being configured to perform image transfer by passing a recording sheet carried on a transfer belt through a nip zone defined between a transfer roller and a photoreceptor drum, as well as an image forming apparatus provided with such a belt transfer apparatus.

BACKGROUND

An electrophotographic image forming apparatus performs image formation by: forming an electrostatic latent image based on image data on the surface of a photoreceptor drum uniformly charged using electrostatic force by an optical write device; developing this electrostatic latent image with toner by a developing device; transferring the resulting toner image to a recording sheet; and then fusing and fixing the toner image to the recording sheet by a fixing device applying heat and pressure to the toner image.

Transfer devices of the charger type have been widely used for image forming apparatus because their structures are simple. In recent years, however, transfer devices of the contact type have become mainstream because the charger type transfer devices generate ozone during discharge for obtaining a transfer power output, thus giving off an unpleasant odor and raising a problem of health.

Such contact type transfer devices include: those which are configured to bring a transfer electrode such as an electrically conductive roller or brush into direct contact with the reverse side of a recording sheet to cause a toner image formed on an image carrier to be transferred to the recording sheet; and those which are configured to interpose a carrier member such as an electrically conductive endless belt or film between a photoreceptor drum and a transfer electrode to achieve image transfer. A transfer roller and a transfer belt used as the transfer electrode and the carrier member, respectively, in these contact type transfer devices need to have predetermined elasticity and pressure in order to stabilize the recording sheet nipping condition of the photoreceptor drum and transfer roller and, therefore, their respective surface portions are formed of an elastic conductive material having a high resistance.

Such high-resistant, elastic conductive materials to be used for the surface portion of such a transfer roller and for such a transfer member as a transfer belt are generally known to have a voltage or current dependence of resistance. Conventional contact type transfer devices use an elastic conductive material having a suppressed voltage or current dependence of resistance for the transfer member in order to stabilize the output of transfer power which influences the transfer process. Among such conventional transfer devices there is known one which has a transfer roller having an absolute value of voltage dependence of resistance ? log R/?V{(log O/kV)} set to not more than 0.5 (see Japanese Patent Laid-Open Publication No. H10-133496 for example). The purpose of this art is to prevent the occurrence of non-uniformity in the density of an image due to variations in transfer efficiency by making uniform the transfer voltage acting on a recording sheet and toner during the transfer process.

If entrance- and exit-side paper guides with respect to the contact position between the surface of a photoreceptor and a transfer member, as well as a fixing device and the like are charged up in an image forming apparatus, it is likely that paper jam, electrostatic discharge damage to an electric circuit or the like due to a high voltage, abnormal discharge, and the like occur. In such an image forming apparatus the transfer member is grounded through a resistance of several hundred KO as measures to avoid such inconveniences.

Further, in order to enhance the release property of a recording sheet from the surface of the transfer member and prevent toner from scattering during the transfer process, the transfer member is grounded or applied with a relatively low voltage. For this reason, there are formed a primary transfer current path passing through the transfer member, recording sheet and photoreceptor from the power source and, in addition, a secondary transfer current path passing through the transfer member from the power source in a different direction than the primary transfer current path. Thus, current passes on the secondary transfer current path also.

If transfer current fluctuations occur in the primary transfer current path including the transfer member and recording sheet due to partial resistance fluctuations in the primary transfer current path, a voltage drop by the transfer member fluctuates to cause the intensity of the transfer electric field in the transfer region to vary. The above-described arrangement can suppress such a variation in the intensity of the transfer electric field to ensure a stabilized transfer operation.

However, as the transfer efficiency of the transfer process, which determines the condition of image formation on a recording sheet, is susceptible to changes with time of the components of the device and to environmental conditions including temperature and humidity, if the voltage- or current-dependence of resistance of the transfer member is suppressed, need for strict control over other electrical conditions arises to ensure a satisfactory condition of image formation on the contrary, thus resulting in a problem that control of power supply to the transfer device during image formation becomes complicated.

An object of the present invention is to provide a belt transfer apparatus which is capable of reducing the susceptibility of the transfer efficiency of the transfer process to changes with time of the components of the device and changes of environmental conditions while facilitating control over power supply to the transfer device during image formation by imparting an appropriate voltage- or current-dependence to the resistance inherent to an elastic conductive material forming a transfer belt serving as the transfer member or to each of resistances of the elastic conductive material in different directions, as well as an image forming apparatus provided with such a belt transfer apparatus.

DISCLOSURE OF INVENTION (1) A belt transfer apparatus comprising an electrically conductive transfer belt moving between a surface of a photoreceptor on which a toner image is formed and a transfer roller applied with a high-voltage power source in a recording sheet feed direction, characterized in that the transfer belt has a resistance having a negative current dependence such that the resistance decreases with increasing transfer current.

With this configuration, when transfer current fluctuations occur due to partial resistance fluctuations at a recording sheet, a member of the transfer device or a like part, the negative current dependence imparted to the resistance of the transfer belt acts to suppress fluctuations of a transfer electric field, thereby ensuring a constantly stabilized transfer operation and keeping the condition of image formation satisfactory.

(2) The belt transfer apparatus is characterized in that a combined resistance R1=Vt1/I1 (MO) of the transfer belt and the recording sheet obtained when a transfer current I1 (μA) passes through the transfer belt and the recording sheet upon application of a first transfer bias voltage Vt1 (V) to the transfer roller from the high-voltage power source and a combined resistance R2=Vt2/I2 (MO) of the transfer belt and the recording sheet obtained when a transfer current I2 (μA) passes through the transfer belt and the recording sheet upon application of a second transfer bias voltage Vt2 (V) to the transfer roller from the high-voltage power source, have the relationship: R2/R1=7?(I2)−0.5 therebetween.

With this feature, the combined resistance of a transfer path on which a transfer current passes is normalized. Therefore, even if members included in the transfer path have different resistances, fluctuations of a transfer electric field are suppressed, which ensures a constantly stabilized transfer operation.

(3) The belt transfer apparatus is characterized in that a combined resistance R1=Vt1/I1 (MO) of the transfer belt and the recording sheet obtained when a transfer current I1 (μA) passes through the transfer belt and the recording sheet upon application of a first transfer bias voltage Vt1 (V) to the transfer roller from the high-voltage power source and a combined resistance R2=Vt2/I2 (MO) of the transfer belt and the recording sheet obtained when a transfer current I2 (μA) passes through the transfer belt and the recording sheet upon application of a second transfer bias voltage Vt2 (V) to the transfer roller from the high-voltage power source, have the relationship: R2/R1=(I2/I1)−0.5 therebetween.

With this feature, a transfer current passing on a transfer path is normalized. Therefore, even if the transfer process is performed under different conditions, fluctuations of a transfer electric field are suppressed, which ensures a constantly stabilized transfer operation.

(4) The belt transfer apparatus is characterized in that a resistance Rb1=Vt1/I1 (MO) of the transfer belt obtained when a transfer current I1 (μA) passes through the transfer belt and the recording sheet upon application of a first transfer bias voltage Vt1 (V) to the transfer roller from the high-voltage power source and a resistance Rb2=Vt2/I2 (MO) of the transfer belt obtained when a transfer current I2 (μA) passes through the transfer belt and the recording sheet upon application of a second transfer bias voltage Vt2 (V) to the transfer roller from the high-voltage power source, have the relationship: Rb2/Rb1=(I2/I1)−1 therebetween.

With this feature, the current dependence of the resistance of the transfer belt forming a transfer path on which a transfer current passes is optimized. Therefore, even if transfer current fluctuations occur due to partial resistance fluctuations at the recording sheet, a member of the transfer device or a like part, fluctuations of a transfer electric field are suppressed, which ensures a constantly stabilized transfer operation.

(5) A belt transfer apparatus comprising a belt-shaped transfer member having contact with a surface of a photoreceptor of an image forming apparatus to sandwich a recording sheet therebetween; a primary transfer current path on which a current from a power source passes through the transfer member and then the photoreceptor; and a secondary transfer current path on which a current from the power source passes through the transfer member in a different direction than the primary transfer current path, characterized in that a voltage drop V1 resulting at the transfer member when a current I1 passes on the primary transfer current path and a voltage drop V2 resulting at the transfer member when a current I2 which is smaller in absolute value than the current I1 passes on the secondary transfer current path, satisfy the expression: |V1/I1|/|V2/I2|<1.

In this configuration, current from the power source passes not only on the primary transfer current path passing through the transfer member and the photoreceptor but also on the second transfer current path passing through the transfer member in a different direction than the primary transfer current path; and the ratio of the voltage drop V2 resulting at the transfer member to the current I2 passing on the secondary transfer current path is set larger than the ratio of the voltage drop V1 resulting at the transfer member to the current I1 passing on the primary transfer current path. Accordingly, even when the transfer current is varied due to partial resistance fluctuations in the secondary transfer current path, the voltage drop at the transfer member does not fluctuate largely and, hence, fluctuations of a transfer electric field in the transfer region are suppressed. Resistance fluctuations in the secondary transfer current path are largely influenced by the resistance of the recording sheet which varies largely due to humidity or a like factor. This is because the recording sheet fed longitudinally of the belt-shaped transfer member can be regarded as a resistance arranged in parallel with the transfer member in the secondary transfer current path including the belt-shaped transfer member longitudinally.

(6) The belt transfer apparatus is characterized in that the voltage drop resulting at the transfer member is substantially constant relative to a variation in the transfer current.

With this feature, the voltage drop resulting at the transfer member is kept substantially constant even when the transfer current varies. Accordingly, the resistance in the secondary transfer current path fluctuates partially due to variations in the resistance of the recording sheet or the like, the transfer electric field between the transfer member and the photoreceptor is kept constant. Also, even when the current distribution in the secondary transfer current path fluctuates partially, fluctuations in the impedance of the entire secondary transfer current path are mitigated, so that fluctuations in the voltage applied to the transfer member from a constant-current power source are mitigated. That is, by imparting the transfer member with a substantially constant dependence on current fluctuations, a stabilized voltage is obtained on the reverse side of the recording sheet. For example, when a current dependence Ni=1 (when R∝I—Ni), the voltage drop at the transfer member is constant without being influenced by current. One example of a device having such a constant-voltage characteristic is a Zener diode.

(7) The belt transfer apparatus is characterized in that the power source has a constant-current characteristic.

With this feature, the transfer member is supplied with the transfer power source having a constant-current characteristic. Accordingly, even when impedance fluctuations occur in the secondary transfer current path, the stability of voltage on the reverse side of the recording sheet is maintained.

(8) The belt transfer apparatus is characterized in that the power source is constant-current controlled while an output current of the power source varies with load.

With this feature, the transfer member is supplied with the transfer power source having a constant-current characteristic which varies with load. Accordingly, even when fluctuations occur in the-impedance of the entire secondary transfer current path, the stability of voltage on the reverse side of the recording sheet is maintained.

(9) The belt transfer apparatus is characterized in that a second secondary transfer current path is formed to ground the power source.

With this feature, the second secondary transfer current path grounding the power source is formed in addition to the primary transfer current path and the secondary transfer current path. Accordingly, even when fluctuations occur in the impedance of the entire secondary transfer current path, the voltage on the reverse side of the recording sheet is more stabilized.

(10) An image forming apparatus configured to carry out an electrophotographic image forming process in which an electrostatic latent image formed on a surface of a photoreceptor is developed into a visible toner image, followed by transfer of the toner image from the photoreceptor to a recording sheet, characterized by comprising a belt transfer apparatus as recited in any one of the items (1) to (9).

With this configuration, when transfer current fluctuations occur due to partial resistance fluctuations at a recording sheet, a member of the transfer device or a like part, the negative current dependence imparted to the resistance of the transfer belt acts to suppress fluctuations of a transfer electric field, thereby ensuring a constantly stabilized transfer operation and keeping the condition of image formation satisfactory.

Also, current from the power source passes not only on the primary transfer current path extending through the transfer member and the photoreceptor but also on the second transfer current path extending through the transfer member in a different direction than the primary transfer current path; and the ratio of the voltage drop V2 resulting at the transfer member to the current I2 passing on the secondary transfer current path is set larger than the ratio of the voltage drop V1 resulting at the transfer member to the current I1 passing on the primary transfer current path. Accordingly, even when the transfer current is varied due to partial resistance fluctuations in the secondary transfer current path, the voltage drop at the transfer member does not fluctuate largely and, hence, fluctuations of a transfer electric field in the transfer region are suppressed, which ensures image formation constantly kept in a proper condition.

BRIEF DESCRIPTION OF DRAWINGS

FIG. 3 is a table showing various values associated with transfer belts used in an image forming experiment.

FIG. 4 is a table showing transfer voltages applied to a transfer roller from a high-voltage power source in the image forming experiment, transfer currents each passing through a respective one of the transfer belts and a recording sheet, and results of image quality evaluation.

BEST MODE FOR CARRYING OUT THE INVENTION

Figure 1:
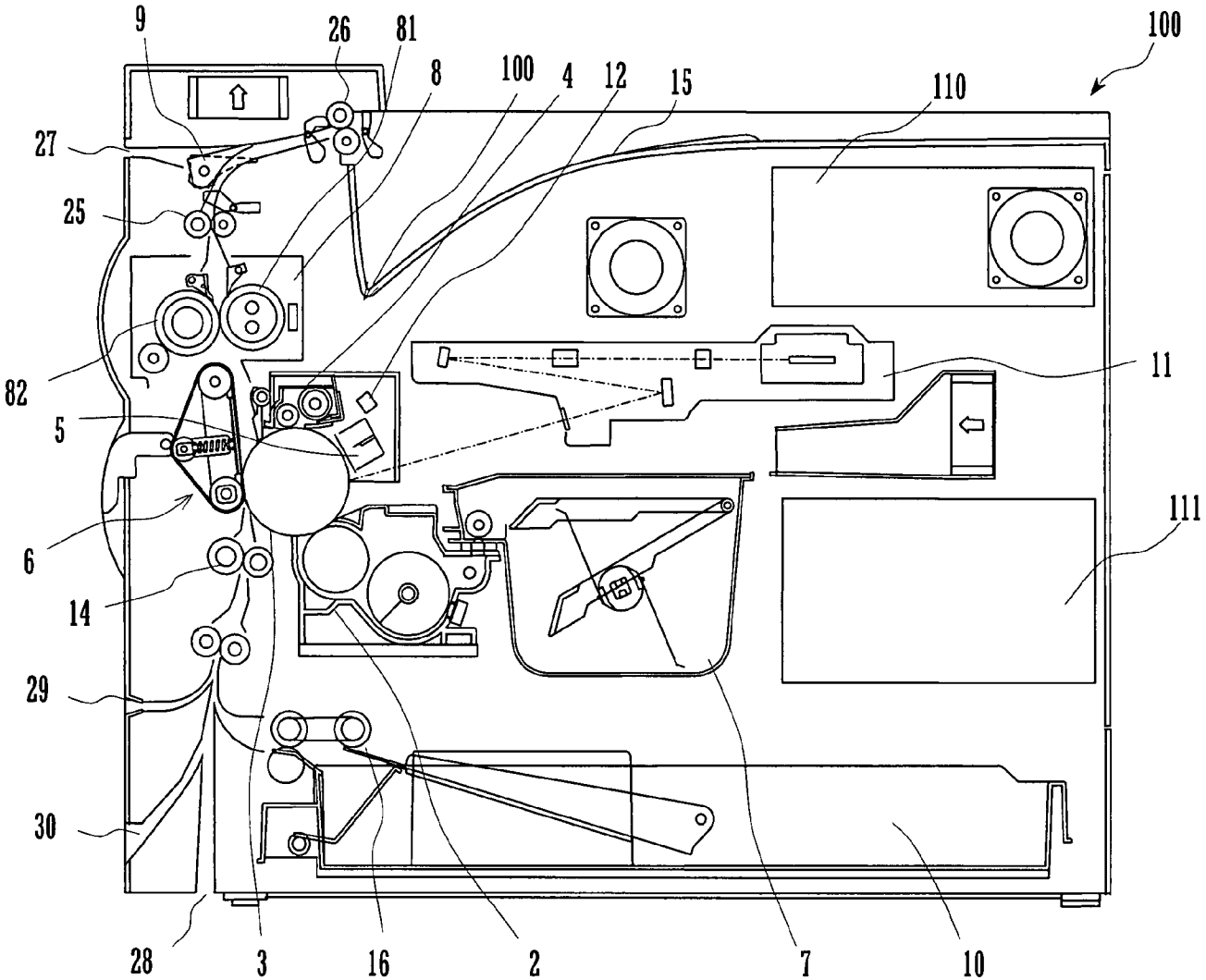
FIG. 1 is a view schematically illustrating the construction of an image forming apparatus provided with a belt transfer apparatus according to an embodiment of the present invention.

FIG. 1 is a view schematically illustrating the construction of an image forming apparatus provided with a belt transfer apparatus according to an embodiment of the present invention. Image forming apparatus 100 is configured to electrophotographically record on a recording sheet an image fed from an external device (an image output device such as a scanner or a personal computer for example) connected thereto.

The image forming apparatus 100 has an image forming section 100*a* in which a photoreceptor drum 3 is rotatably supported. Around the photoreceptor drum 3 are disposed an electrostatic charger 5, an optical scanning unit 11, a developing unit 2, a transfer device 6, a cleaning unit 4, a static eliminator lamp 12 and the like in this order along the direction of rotation of the photoreceptor drum 3.

The electrostatic charger 5 electrostatically charges the surface of photoreceptor drum 3 uniformly. The optical scanning unit 11 irradiates the uniformly charged surface of the photoreceptor drum 3 with a light image by scanning thereby to write an electrostatic latent image to the photoreceptor drum 3. The developing unit 2 develops the electrostatic latent image into a visible toner image with toner fed from a developer supply container 7. The transfer device 6 transfers the toner image formed on the photoreceptor drum 3 to a recording sheet. The cleaning unit 4 removes residual toner remaining on the surface of the photoreceptor drum 3 to make the photoreceptor drum 3 ready to form a fresh image thereon. The static eliminator lamp 12 eliminates electrostatic charge remaining on the surface of the photoreceptor drum 3.

A feed tray 10 is removably disposed in a lower portion of the image forming apparatus 100. The feed tray 10 contains recording sheets therein. The recording sheets contained in the feed tray 10 are separated one from another and then transported to a registration roller 14 by a pickup roller 16 and the like. The registration roller 14 feeds each recording sheet to between the transfer device 6 and the photoreceptor drum 3 with timing synchronous with an image formed on the surface of photoreceptor drum 3. The toner image formed on the surface of photoreceptor drum 3 is transferred to the recording sheet by the transfer device 6. In replenishing the feed tray 10 with recording sheets, the feed tray 10 is withdrawn toward the front side (operating side) of the image forming apparatus 100.

A sheet receiving inlet 28 is open in the bottom of the image forming apparatus 100. The sheet receiving inlet 28 receives and takes into the image forming apparatus 100 recording sheets fed from a feed tray included in a desk device (not shown) serving as a peripheral device for carrying the image forming apparatus 100 thereon. Recording sheets other than those contained in the feed tray 10 are taken into the image forming apparatus 100 from an extended receiving section 30.

A fixing device 8 is disposed within the image forming apparatus 100 in an upper portion thereof. The fixing device 8 fixes the toner image to the recording sheet by passing the recording sheet bearing the toner image transferred thereto between a heating roller 81 and a pressure roller 82. In this way the image is recorded on the recording sheet.

The recording sheet bearing the image recorded thereon is transported upwardly by a transport roller 25 to pass through a switching gate 9. In the case where the recording sheet delivery position is established on a carrier tray 15 provided on the exterior of the image forming apparatus 100, the recording sheet is ejected onto the carrier tray 15 by a reverse roller 26. On the other hand, in the case where an instruction to perform a double-side image forming process or a post-processing operation is given, the reverse roller 26 half ejects the recording sheet toward the carrier tray 15, stops operating while nipping the trailing edge of the recording sheet, and then rotates backwardly. Thus, the recording sheet is transported, via a delivery path 27, to a recording material re-feeder (not shown) or a post-processing device (not shown), which are selectively attached to a lateral side of the image forming apparatus 100 for the double-side image forming process or the post-processing operation. At that time the switching gate 9 is switched from the state depicted by solid line to the state depicted by broken line in FIG. 1.

In the double-side image forming process, the sheet transported in the reversed condition passes through the recording material re-feeder and is then fed into the image forming apparatus 100 again via a re-feed path 29. In the post-processing operation, the recording sheet is transported from the recording material re-feeder to the post-processing device via a non-illustrated relay feeder through another switching gate.

In the spaces above and below the optical scanning unit 11 are disposed a control section 110 including a circuit board for controlling the image forming process and an interface board for receiving image data from external equipment, and a power source unit 111 and the like for supplying electric power to the interface board and to each of the aforementioned sections or parts performing image formation.

Figure 2:
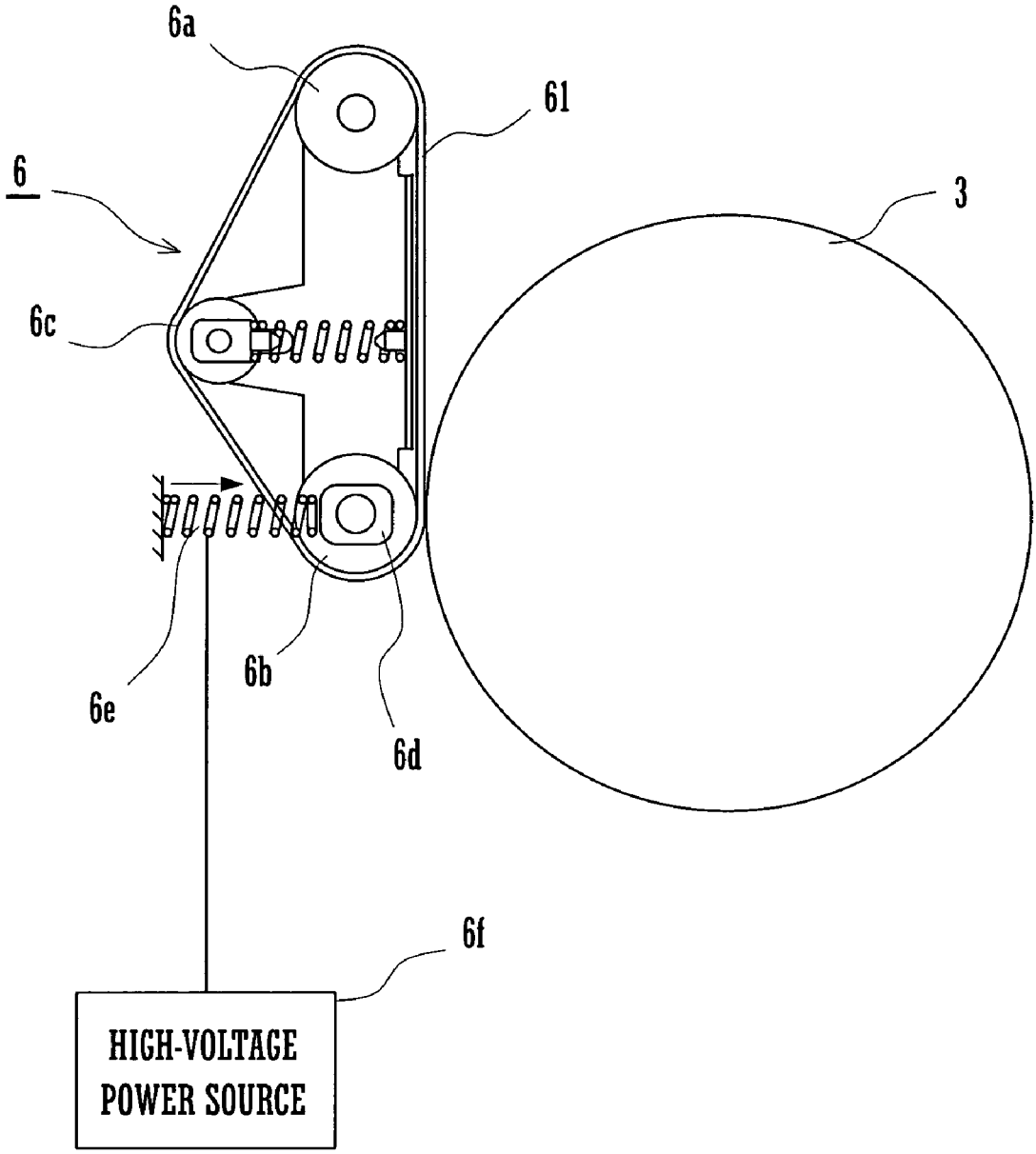
FIG. 2 is a view illustrating the configuration of a belt transfer apparatus according to a first embodiment of the present invention.

FIG. 2 is a view illustrating a configuration of a belt transfer apparatus according to a first embodiment of the present invention for use in the above-described image forming apparatus 100. The transfer device 6 in the image forming section 100*a* of the image forming apparatus 100 includes a transfer roller 6*a*, a driving roller 6*b*, a tension roller 6*c*, and a transfer belt 61 entrained about these rollers 6*a* to 6*c*.The tension roller 6*c* may be eliminated if the driving roller 6*a* or the transfer roller 6*b* is imparted with a tensioning function.

The transfer belt 61 comprising urethane or EPDM (ethylene-propylene-diene terpolymer rubber) as a major material is shaped into an endless form by extrusion, centrifugal molding or a like process. The transfer belt 61 is electrically conductive and has a thickness within a range of from about 0.5 to 0.65 mm for example. The transfer belt 6D has a volume resistance of $10^{11}$ to $10^{12}$ Ocm.

If the thickness of the transfer belt 61 is smaller than the aforementioned range, the transfer belt 61 becomes wrinkled under a large force causing the transfer belt 61 to lean on one side, thus resulting in degraded image quality. If the thickness of the transfer belt 61 is larger than the aforementioned range, the transfer belt 61 has an increased apparent hardness, so that the transfer belt 61 meanders easily under a force causing the transfer belt 61 to lean on one side, thus resulting in recording sheet jam or damage to the transfer belt 61.

The transfer roller 6*a* comprises a core formed of a rod material of stainless steel or other iron material, and an electrically conductive elastic member of urethane rubber, EPDM or the like covering the periphery of the core. The transfer roller 6*a* has an outside diameter of about 18 mm. The conductive elastic member has a volume resistance of about $10^6$ Ocm and a hardness of 45 to 60 degrees (Ascar C). The conductive elastic member comprises a single layer or plural layers.

The transfer roller 6*a* is biased to press against the photoreceptor drum 3 across the transfer belt 61 by an electrically conductive compression spring 6*e* formed of steel wire for spring such as stainless steel wire for example. The conductive spring 6*e* applies an electrically conductive bearing 6*d* which supports end portions of the transfer roller 6*a* with a force about 500 g to about 1.5 kg on one side of the transfer roller 6*a*, hence, a force of about 1 to about 3 kg on the whole of the transfer roller 6*a*.

The core of the transfer roller 6*a* is applied with a transfer bias having an opposite polarity to electrostatically charged toner from a high-voltage power source 6*f* via the conductive spring 6*e* and conductive bearing 6*d* and is constant-current controlled by a non-illustrated control circuit so that a transfer current of 20-40 μA passes therethrough. Due to the constant-current control, the voltage applied to the transfer roller 6*a* varies within a range of from 500V to 4 kV depending upon the material of the recording sheet and environmental conditions.

The driving roller 6*b* has a central portion having a slightly smaller outside diameter (by about 4 mm) than opposite end portions thereof so as to obviate the occurrence of deflection in a central portion of the transfer belt 61 along the axis of rotation by tension. Since the transfer belt 61 formed from a rubber material having a high coefficient of friction, the driving roller 6*b* comprises a metallic roller of stainless steel, aluminum or a like material to increase its outside diameter precision and suppress shaking of the transfer belt 61 thereby ensuring satisfactory performance in feeding the transfer belt 61.

The tension roller 6*c* is a metallic roller of an iron material such as stainless steel. Where the space provided for the transfer device 6 in the image forming apparatus 100 has leeway, the tension roller 6*c* may comprise a roller of an aluminum material having an increased outside diameter. The tension roller 6*c* imposes a load of about 1.2 kg on the transfer belt 61 from each of its opposite ends, hence a total load of about 2.4 kg to generate tension on the transfer belt 61.

Four types of transfer belts 61*a* to 61*d*, which were different in current (voltage) dependence of resistance from each other as shown in FIG. 3, were selectively used in the transfer device 6*a* thus configured to compare the conditions of respective resulting images formed on respective recording sheets one with another in order to determine an optimal current dependence of resistance of the transfer belt 61. The results of this experiment were as follows.

The transfer belts 61*a* to 61*c* of the four transfer belts 61*a* to 61*d* shown in FIG. 3 are examples of the present invention each having a negative current dependence that the resistance of a transfer belt decreases with increasing transfer current, while the transfer belt 61*d* is a comparative example having a suppressed voltage dependence of resistance. FIG. 4 is a table showing transfer voltages applied to the transfer roller 6*d* from the high-voltage power source 6*f*, transfer currents each having passed through a respective one of the transfer belts 61*a* to 61*d* and a recording sheet, and results of image quality evaluation in the image forming experiment where the transfer belts 61*a* to 61*d* were used. FIGS. 4(A), 4(B), 4(C) and 4(D), respectively, show the results of experiments using respective transfer belts 61*a* to 61*d*. In FIG. 4, the term "BK roughness" used to evaluate image quality means a non-uniform density condition of a solid black image and the term "HT roughness" means a non-uniform density condition of a halftone image. In both evaluations, a considerably non-uniform density condition is represented by "x", a slightly non-uniform density condition represented by "?", and a substantially no non-uniform density condition represented by "?".

As seen from FIG. 4, the use of the comparative example transfer belt 61*d* having a suppressed voltage dependence of resistance offered a narrower range of transfer voltage ensuring a satisfactory condition of image formation than the use of any one of the example transfer belts 61*a* to 61*c* each having the negative current dependence that the resistance of a transfer belt decreases with increasing transfer current. This means that a strict transfer voltage control is necessary for keeping the condition of image formation satisfactory.

Figure 5:
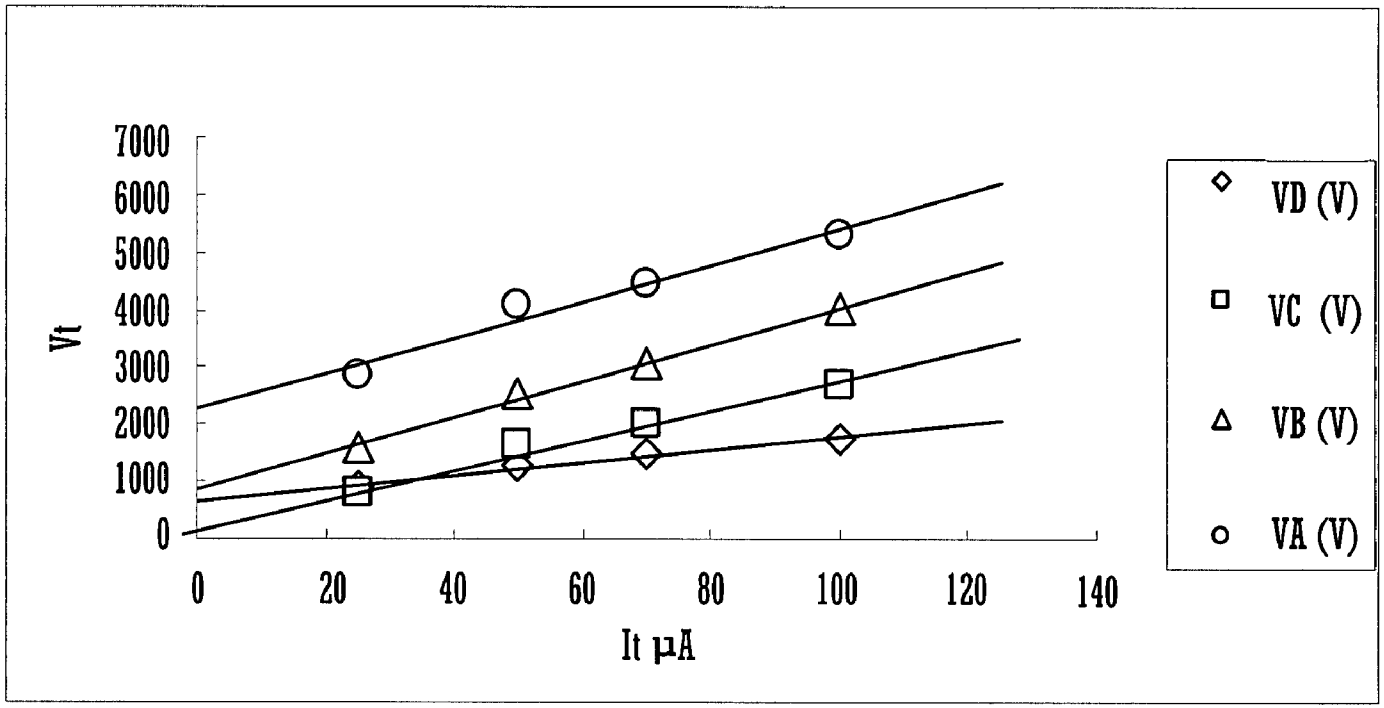
FIG. 5 is a graph showing the relationship between a transfer voltage and a transfer current according to the results of the image forming experiment.

FIG. 5 is a graph showing the relationship between a transfer voltage and a transfer current according to the results of the image forming experiments using respective of the four types of transfer belts. According to the results of the experiments using the example transfer belts 61*a* to 61*c*, the relationships between transfer voltages VA to VC and corresponding transfer currents for the three example transfer belts 61*a* to 61*c* exhibited respective gradients that were substantially uniform. In contrast, according to the result of the experiment using the comparative example transfer belt 61*d*, the relationship between transfer voltages VA to VC and corresponding transfer currents exhibited a gentler gradient than any one of the relationships for the example transfer belts 61*a* to 61*c*. This is because the transfer belt 61*d* had a suppressed voltage dependence of resistance.

Figure 6:
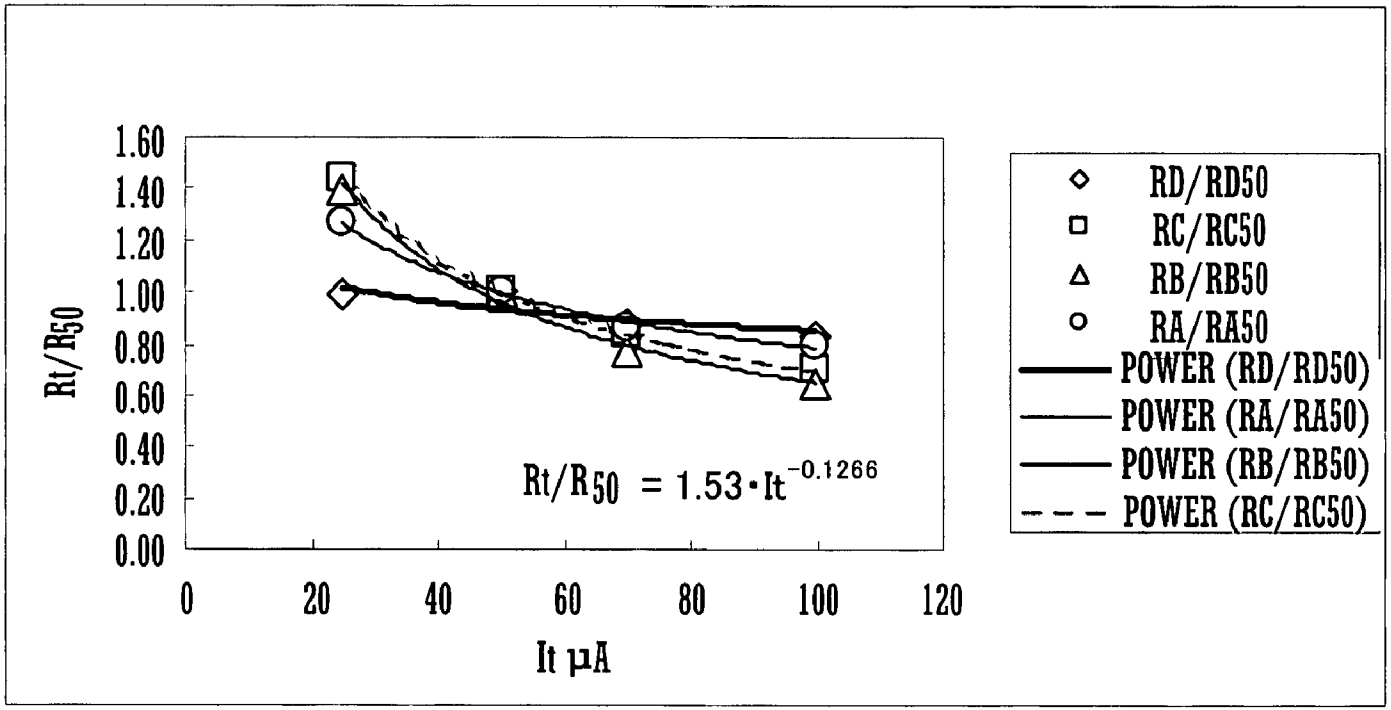
FIG. 6 is a graph showing the relationship between the normalized transfer resistance of each of the transfer belt and a transfer current according to the results of the image forming experiment.

FIG. 6 is a graph showing the relationship between a normalized transfer resistance R/(μA) and a transfer current It (μA) wherein the normalized transfer resistance $R/R_{50}$ was obtained by normalization using a combined resistance comprising the resistance of each of the transfer belts 61*a* to 61*d* and the resistance of a recording sheet as transfer resistance R (O)=voltage Vt (V)/transfer current It (μA) and a transfer resistance $R_{50}$ obtained when the transfer current was 50 (μA). In FIG. 6, RA, RB, RC and RD represent respective transfer resistances obtained when transfer belts 61*a*, 61*b*, 61*c* and 61*d*, respectively, were used.

Figure 7:
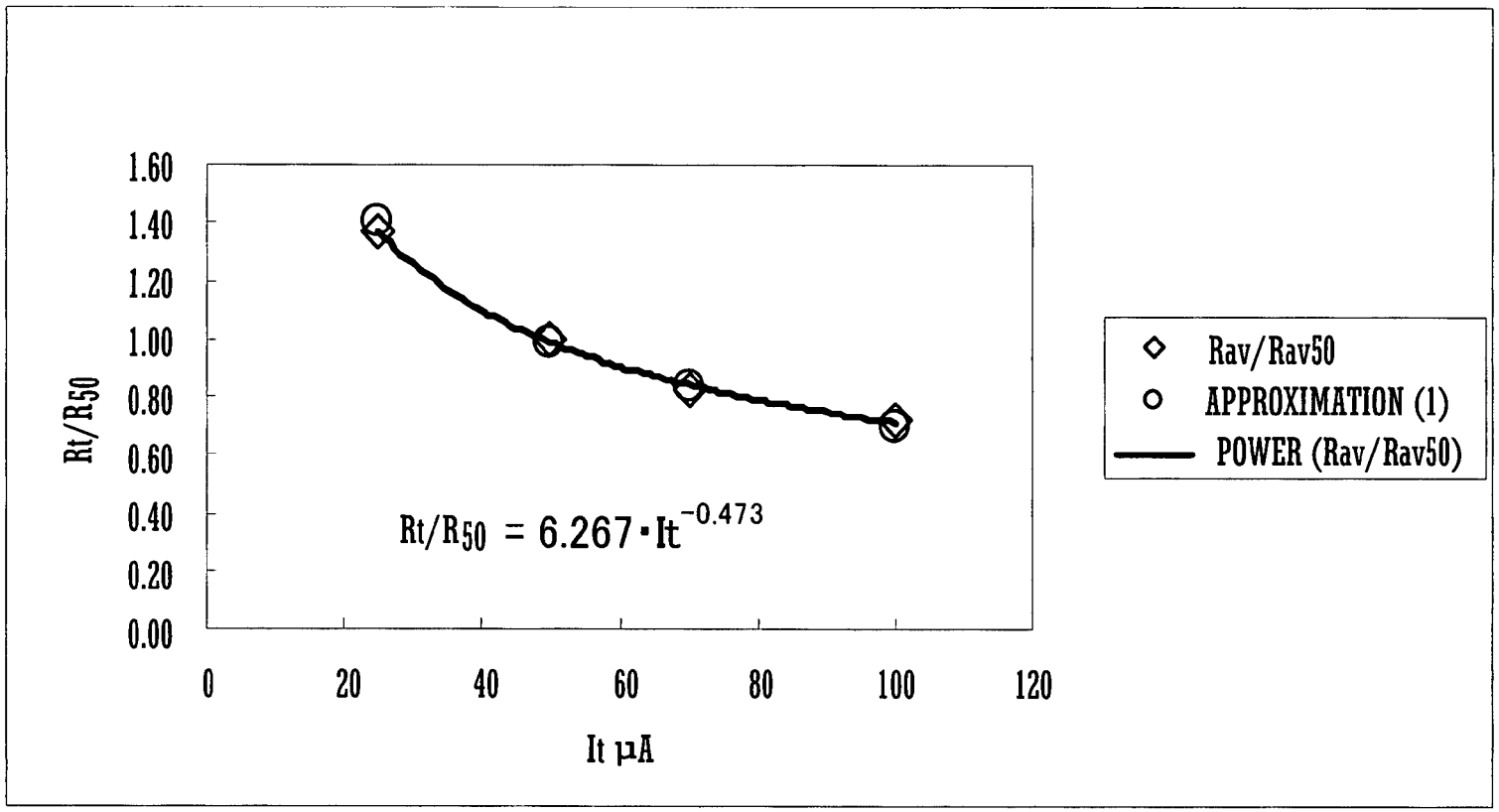
FIG. 7 is a graph showing an approximate expression of a normalized transfer resistance according to the results of an experiment using transfer belts according to embodiments of the present invention.

The approximate expression of normalized resistance $Rt/R_{50}$ obtained from the result of the experiment using the comparative example transfer belt 61*d* appears as $Rt/R^{50}=1.53?It^{-0.1266}$ as shown in FIG. 6. On the other hand, the approximate expression of normalized resistance $Rt/R_{50}$ obtained from the result of each of the experiments using the example transfer belts 61*a* to 61*c* appears as $Rt/R^{50}=6.267?It^{-0.473}$ as shown in FIG. 7. Here, the values of this approximate expression are rounded to give the expression 1:

$$Rt/R_{50}=7?It^{-0.5} \qquad \text{expression 1.}$$

Even the rounded expression 1 matches with measured values. Therefore, if the transfer belt 61 is formed to have a resistance satisfying the expression 1, it is possible for a variation in transfer current to have little influence on the condition of image formation and, hence, a constantly satisfactory condition of image formation can be realized notwithstanding deteriorations with time of the components of the device and changes in environmental conditions.

Figure 8:
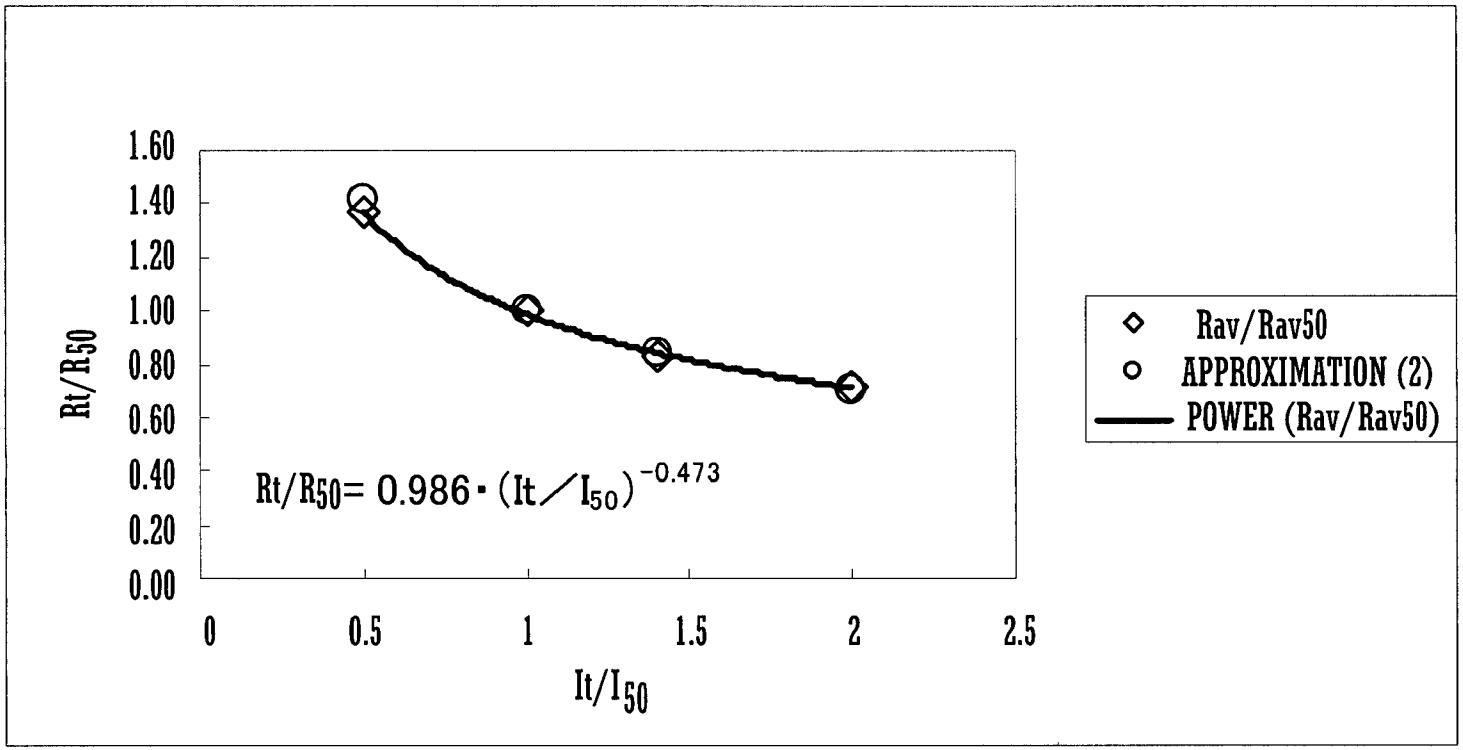
FIG. 8 is a graph showing the relationship between a normalized transfer current and a normalized transfer resistance according to the results of the experiment using transfer belts according to embodiments of the present invention.

The relationship between normalized transfer resistance $Rt/R_{50}$ and normalized transfer current $It/I_{50}$ obtained by normalization of the transfer current according to the results of the experiments using the example transfer belts 61*a* to 61*c* was as shown in FIG. 8. The approximate expression of this relationship appears as $Rt/R_{50}=0.986?(It/I_{50})^{-0.473}$. Here, the values of this approximate expression are rounded to give the expression 2:

$$Rt/R_{50}=(It/I_{50})^{-0.5} \qquad \text{expression 2.}$$

The approximate solution of the rounded expression 2 matches with $Rav/Rav_{50}$, which is a means value of measured values of normalized resistance, as shown in FIG. 8. Therefore, if the transfer belt 61 is formed to have a resistance satisfying the expression 2, it is possible for a variation in transfer current to have little influence on the condition of image formation and, hence, a constantly satisfactory condition of image formation can be realized notwithstanding deteriorations with time of the components of the device and changes in environmental conditions.

Figure 9:
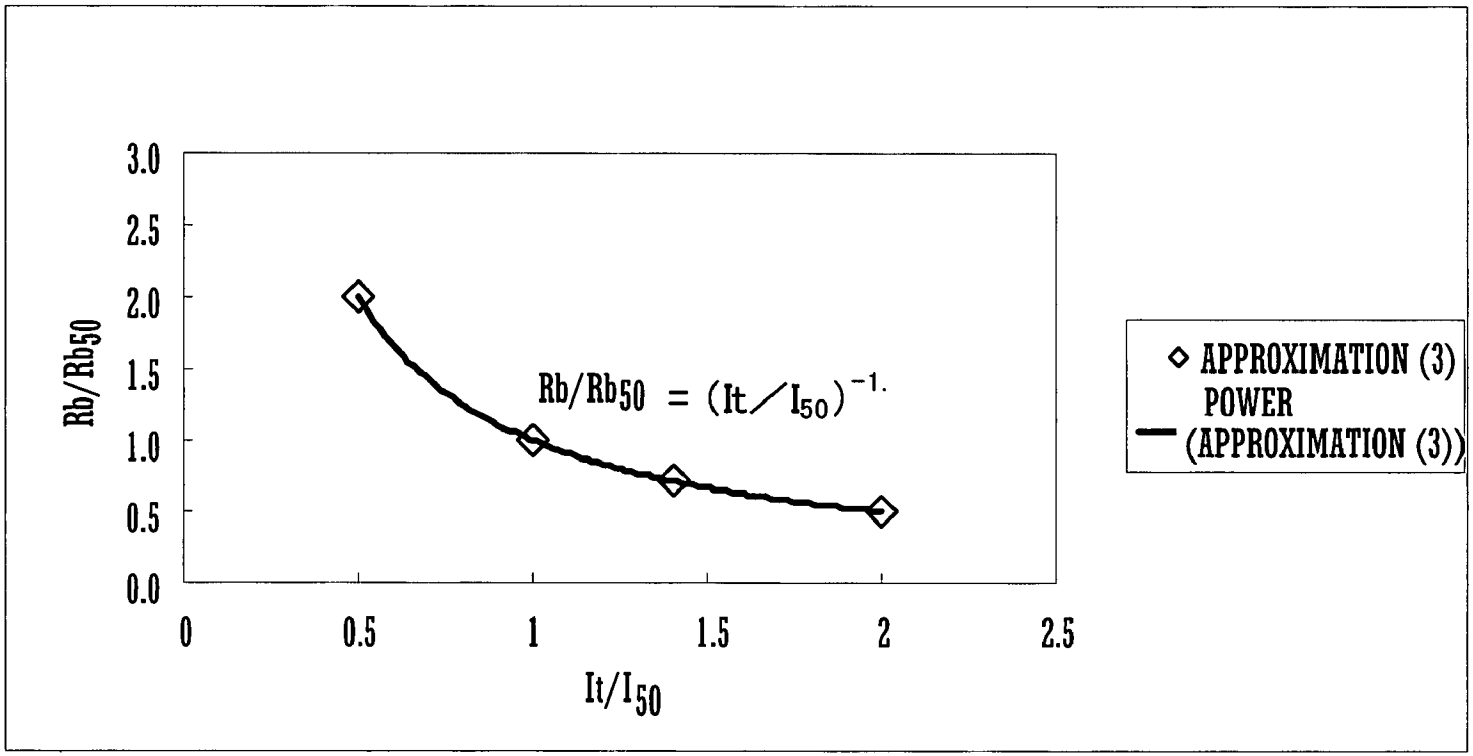
FIG. 9 is a graph for determining an approximate expression according to which the normalized resistance of a transfer belt varies from a 2-times value thereof to a 0.5-times value thereof.

Further, FIG. 9 shows approximate expression 3 by which the normalized resistance $Rb/Rb_{50}$ of each of the transfer belts 61*a* to 61*c* is varied from a 2-times value to a 0.5-times value.

$$Rb/Rb_{50}=(It/I_{50})^{-1} \qquad \text{expression 3}$$

Figure 10:
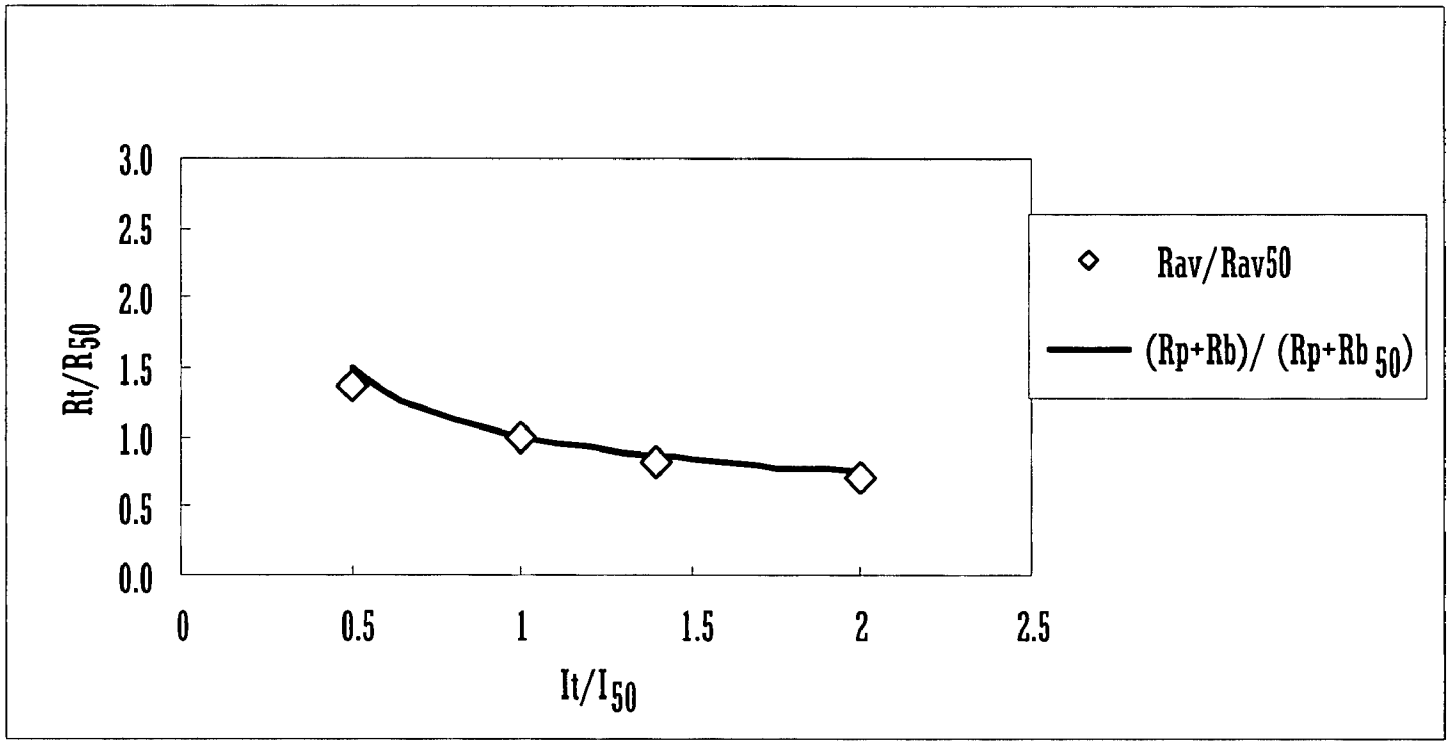
FIG. 10 is a graph showing the relationship between a normalized transfer resistance and a normalized transfer current obtained when the resistance Rp of a recording sheet included in a transfer path was Rb50 (Rp=Rb50).

A normalized transfer resistance resulting when the resistance Rp of the recording sheet included in the transfer path is $Rb_{50}$ is determined by $(Rp+Rb)/(Rp+Rb_{50})$, or normalized transfer resistance=(Rp+Rb)/(Rp+$Rb_{50}$). The normalized transfer resistance thus obtained matches with Rav/$Rav_{50}$, which is a means value of measured values of normalized resistance, as shown in FIG. 10. Therefore, if the transfer belt 61 is formed to have a resistance satisfying the expression 3, it is possible for a variation in transfer current to have little influence on the condition of image formation and, hence, a constantly satisfactory condition of image formation can be realized notwithstanding deteriorations with time of the components of the device and changes in environmental conditions.

It should be noted that $R_{50}$, Rt, It, $I_{50}$, Rb and $Rb_{50}$ in the above-noted expressions 1 to 3 correspond to R1, R2, I2, Rb2 and Rb1 of the present invention.

More specific considerations will be given to the aforementioned results of the experiment. Assuming that for example the resistance of the recording sheet is small enough, when the resistance Rp of the recording sheet varies to 2?Rp or Rp/2, transfer currents $I_1$, $I_2$ and $I_3$ and voltages $V_1$, $V_2$ and $V_3$ applied to the recording sheet, which are obtained by the use of the comparative example transfer belt 61*d* having a suppressed voltage (current) dependence, are as follows:

$$I_1=Vt/(Rb+2?Rp)$$

$$I_2=Vt/(Rb+Rp)$$

$$I_3=Vt/(Rb+Rp/2)$$

$$V_1=2?Rp?Vt/(Rb+2?Rp)$$

$$V_2=Rp?Vt/(Rb+Rp)$$

$$V_3=(Rp/2)?Vt/(Rb+Rp/2).$$

It follows that:

$$V_1/V_2=2(Rb+Rp)/(Rb+2?Rp)=1.33;\text{ and}$$

$$V_3/V_2=(Rb+Rp)/\{2(Rb+Rp/2)\}=0.67.$$

This means that the transfer voltage applied to the recording sheet fluctuates largely with fluctuations in resistance.

In the case of the example transfer belts 61*a* to 61*c*, in contrast, when the resistance Rp of the recording sheet varies to 2?Rp or Rp/2, the resistance Rb of the transfer belt 61 varies to (Rb+?$R_1$) or (Rb−?$R_3$). Accordingly, resulting transfer currents $I_1$, $I_2$ and $I_3$ and resulting voltages $V_1$, $V_2$ and $V_3$ applied to the recording sheet are as follows:

$$I_1=Vt/(Rb+?R_1+2?Rp)$$

$$I_2=Vt/(Rb+Rp)$$

$$I_3=Vt/(Rb-?R_3+Rp/2)$$

$$V_1=2?Rp?Vt/(Rb+?R_1+2?Rp)$$

$$V_2=Rp?Vt/(Rb+Rp)$$

$$V_3=(Rp/2)?Vt/(Rb-?R_3+Rp/2).$$

Assuming that: Rb=Rp; ?$R_1$=Rb/2; and ?$R_3$=Rb/4 for example, it follows that:

$$V_1/V_2=2(Rb+Rp)/(Rb+?R_1+2?Rp)=1.14;\text{ and}$$

$$V_3/V_2=(Rb+Rp)/\{2(Rb-?R_3+Rp/2)\}=0.8.$$

Particularly, assuming that: ?$R_1$=Rb; and ?$R_3$=Rb/2, it follows that:

$$V_1/V_2=2(Rb+Rp)/(Rb+?R_1+2?Rp)=1.00;\text{ and}$$

$$V_3/V_2=(Rb+Rp)/\{2(Rb-?R_3+Rp/2)\}=1.00.$$

This means that fluctuations of a transfer electric field can be suppressed. Thus, it can be understood that with the use of any one of the example transfer belts 61*a* to 61*c*, it is possible for a variation in transfer current to have little influence on the condition of image formation and, hence, a constantly satisfactory condition of image formation can be realized notwithstanding deteriorations with time of the components of the device and changes in environmental conditions.

Figure 11:
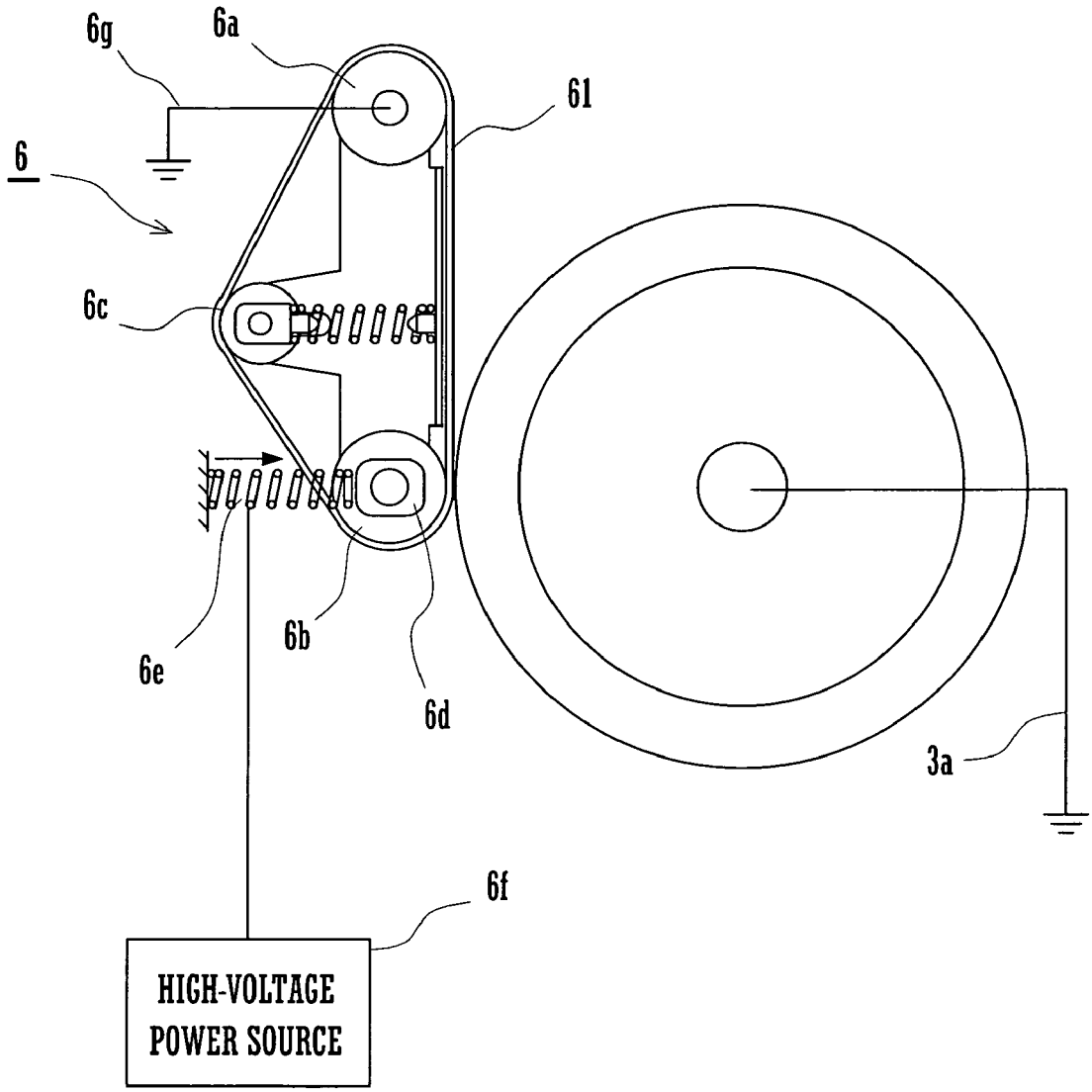
FIG. 11 is a view illustrating a configuration of a belt transfer apparatus according to a second embodiment of the present invention.

FIG. 11 is a view illustrating a configuration of a belt transfer apparatus according to a second embodiment of the present invention for use in the above-described image forming apparatus. The transfer device 6 according to this embodiment has the same configuration as the transfer device 6 shown in FIG. 2 except that the driving roller 6*a* about which the transfer belt 61 is entrained is grounded via a grounding line 6*g*.

Note that the photoreceptor drum 3 comprises an electrically conductive cylindrical substrate of aluminum or a like material, and a photoreceptive layer formed on the surface of the substrate, the photoreceptive layer comprising a charge generating layer and a charge transport layer. The photoreceptor drum 3 is grounded via a grounding line 3*a*.

Figure 12:
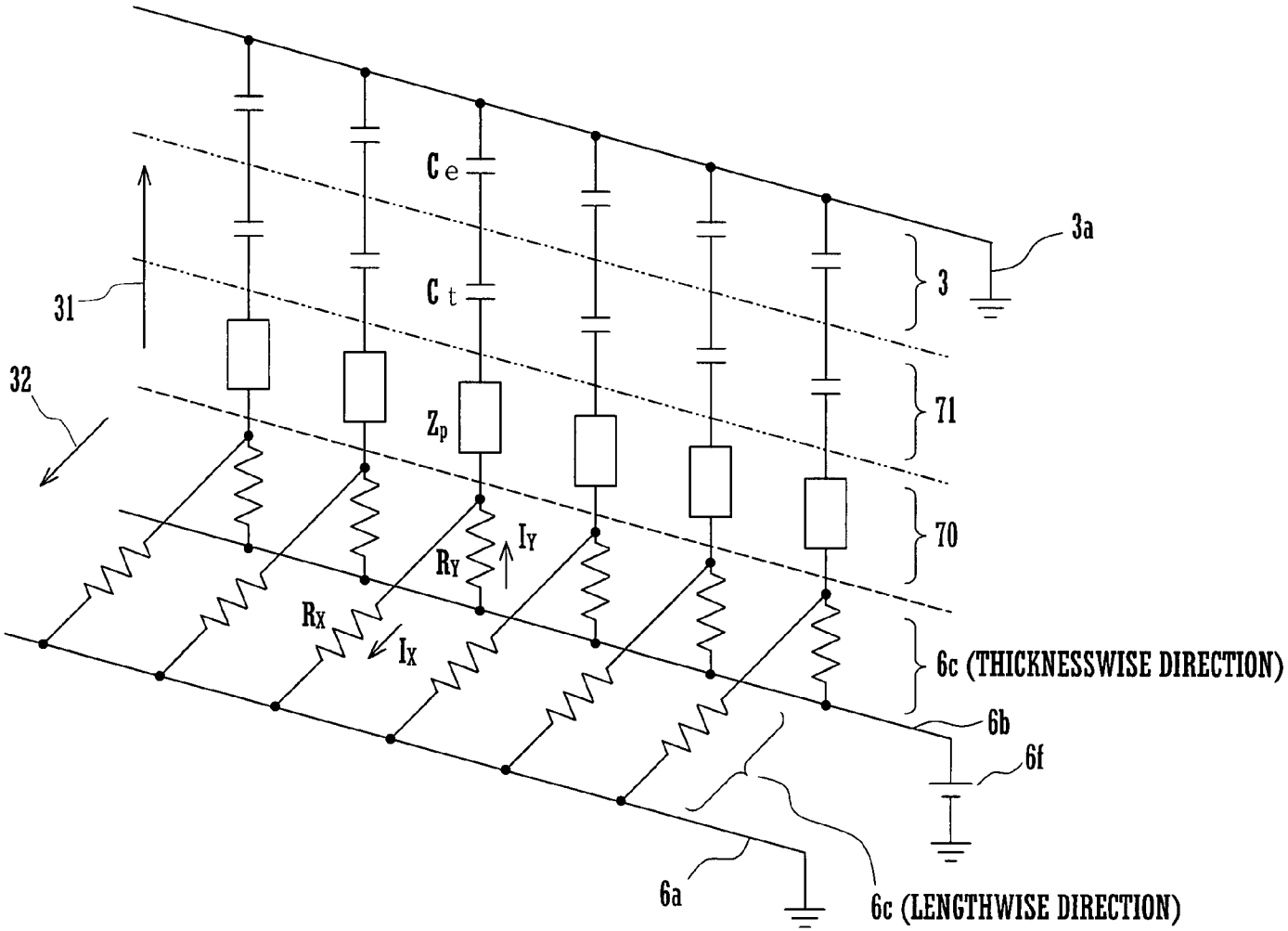
FIG. 12 is a circuit diagram of a portion of concern of an image forming apparatus including the belt transfer apparatus shown in FIG. 11.

FIG. 12 is a circuit diagram of a portion of concern of the image forming apparatus including the belt transfer apparatus according to the second embodiment. In image formation by the image forming apparatus 100, the transfer belt 61 to be fed with a transfer current from the high-voltage power source 6*f* via the transfer roller 6*b* has contact with the surface of photoreceptor drum 3 in the thicknesswise direction thereof to sandwich recording sheet 70 and toner 71 therebetween. Accordingly, there is formed a path (primary transfer current path 31) on which a transfer current passes from the high-voltage power source 6*f* to the grounding line 3*a* through transfer roller 6*b*, transfer belt 61 in the thicknesswise direction thereof, recording sheet 70, toner 71 and photoreceptor drum 3.

Since the driving roller 6*a* about which the transfer belt 61 is entrained is grounded via the grounding line 6*g*, there is also formed a path (secondary transfer current path 32) on which a transfer current passes from the high-voltage power source 6*f* to the grounding line 6*g* through transfer roller 6*b*, transfer belt 61 in the lengthwise direction thereof and driving roller 6*a*. That is, the secondary transfer current path 32 is formed to intersect the primary transfer current path 31 perpendicularly thereto in the transfer belt 61.

Assume that a current passing on the primary transfer current path 31 and a current passing on the secondary transfer current path 32 are Iy (the current I1 defined by the present invention) and Ix (the current I2 defined by the present invention), respectively, in the above-described configuration. In the primary transfer current path 31, transfer belt 61, recording sheet 70, toner 71 and photoreceptor drum 6 can be regarded as resistance (Ry), impedance (Zp), capacitor (Ct) and capacitor (Ce), respectively. Also, the transfer belt 61 can be regarded as resistance (Rx) in the secondary transfer current path 32. The recording sheet 70 fed lengthwise of the transfer belt 61 can be regarded as a resistance arranged in parallel with the transfer belt 61 in the secondary transfer current path 32. Therefore, the resistance of the recording sheet, which is largely variable depending on humidity and the like, influences the secondary transfer current path 32 in such a manner that variations in the resistance of the recording sheet causes the resistance of the secondary transfer current path 32 to fluctuate.

The belt transfer apparatus 6 of the present invention is configured such that the aforementioned currents Ix and Iy and voltage drops Vx and Vy at the transfer belt 61 satisfy he expression 4:

$$|Vy/Iy|/|Vx/Ix|<1 \qquad \text{expression 4.}$$

That is, when current from the high-voltage power source 6*f* passes not only on the primary transfer current path 31 but also on the second transfer current path 32, the ratio of the voltage drop Vx at the transfer belt 61 to the current Ix passing on the secondary transfer current path 32 is set larger than the ratio of the voltage drop Vy at the transfer belt 61 to the current Iy passing on the primary transfer current path 31. Accordingly, even when the transfer current is varied due to partial resistance fluctuations at the transfer belt 61 or the recording sheet in the primary transfer current path 31, the voltage drop at the transfer belt 61 does not fluctuate largely and, hence, fluctuations of the transfer electric field in the transfer region formed between the transfer belt 61 and the photoreceptor drum 3 can be suppressed, which ensures a constantly stabilized transfer operation. Thus, the condition of image formation can be kept satisfactory.

The secondary transfer current path 32 is provided for the purpose of avoiding paper jam due to charge-up of a member forming the sheet feed path for example, electrostatic discharge damage to an electric circuit or the like due to a high voltage, abnormal discharge, and the like. Another purpose of the secondary transfer current path 32 is to enhance the release property of the recording sheet from the transfer belt 61 and prevent toner from scattering during the transfer process.

The voltage drop at the transfer belt 61 is kept substantially constant even when the transfer current varies. Accordingly, even when the resistance of the secondary transfer current path 32 fluctuates partially, the transfer electric field between the transfer belt 61 and the photoreceptor drum 3 is kept constant, thus ensuring a constantly stabilized transfer operation. Also, even when the current distribution in the secondary transfer current path 32 fluctuates partially, fluctuations in the impedance of the entire secondary transfer current path 32 are mitigated, so that fluctuations in the voltage applied to the transfer belt 61 from the high-voltage power source 6*f* are mitigated. That is, by imparting the transfer belt 61 with a substantially constant current dependence on current fluctuations, a stabilized voltage can be obtained on the reverse side of the recording sheet. If the high-voltage power source 6*f* is imparted with a constant-voltage characteristic using, for example, a Zener diode so that the current dependence Ni is 1 ($R \propto I^{-Ni}$), the voltage drop at the transfer belt 61 becomes constant without being influenced by current.

Further, the transfer belt 61 is supplied with a power source having a constant-current characteristic from the high-voltage power source 6*f*. Accordingly, even when impedance fluctuations occur in the secondary transfer current path 32, the stability of voltage on the reverse side of the recording sheet is maintained.

In addition, the transfer belt 61 can be supplied with a power source having a constant-current characteristic which is variable with load from the high-voltage power source 6*f*. Accordingly, even when impedance fluctuations occur in the entire secondary transfer current path 32, the stability of voltage on the reverse side of the recording sheet is maintained.

Figure 13:
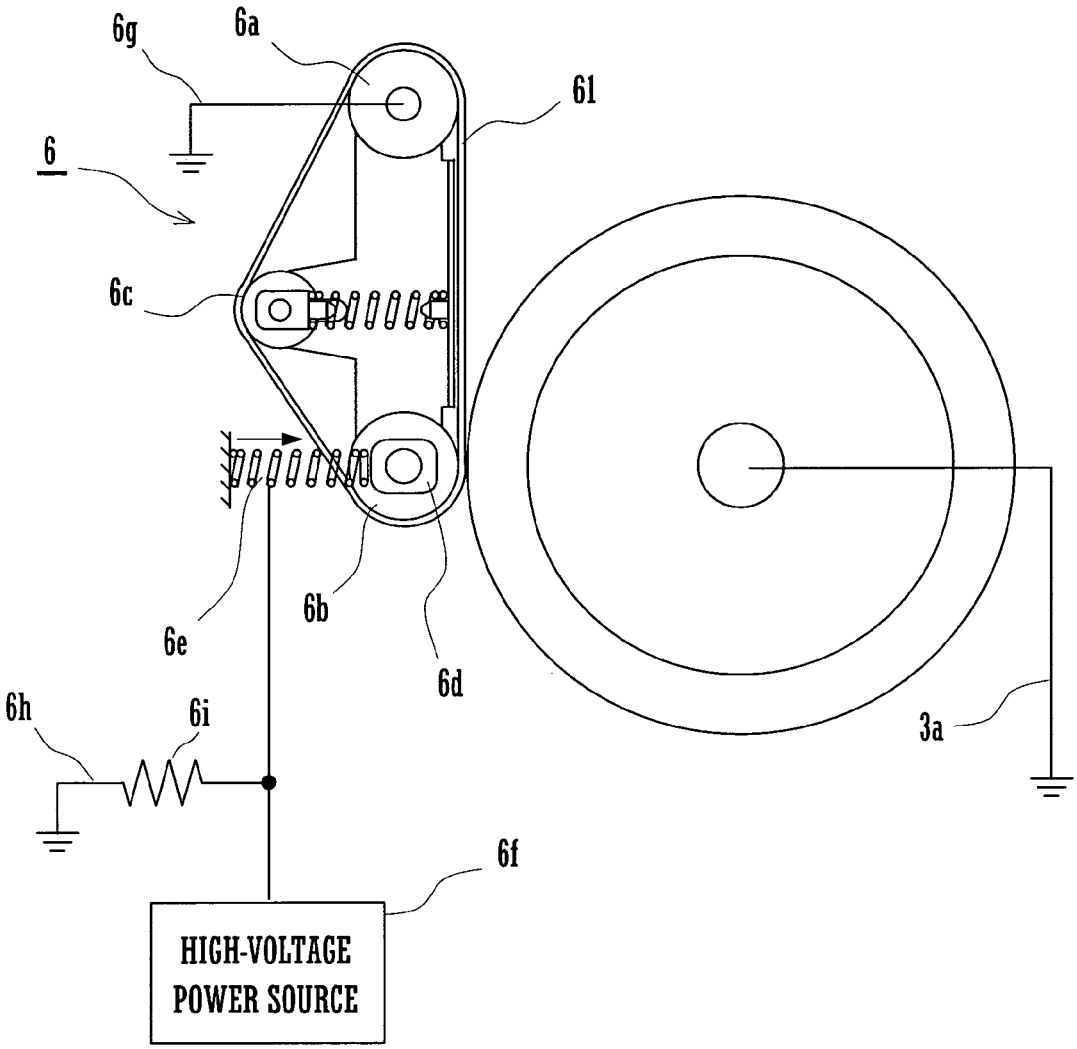
FIG. 13 is a view illustrating another configuration of the belt transfer apparatus according to the second embodiment of the present invention.

It is possible to form a grounding line 6*h* including a resistance 6*i* for example between the high-voltage power source 6*f* and the transfer belt 61 as a part of a second secondary transfer current path, as shown in FIG. 13. This feature can further stabilize the voltage on the reverse side of the recording sheet during occurrence of impedance fluctuations in the entire secondary transfer current path.

The voltage Vh of the high-voltage power source 6*f*, surface potential Vpo of the photoreceptor drum 3, charge potential Vt of toner 71, and voltage drop Vrp at the transfer belt 61 are set to satisfy the expression 5:

$$Vh-Vpo-0.85Vt \geqq Vrp \geqq Vh-Vpo-1.15Vt \qquad \text{expression 5.}$$

The development equation determining the development efficiency of the development process for transferring toner from the developing device to the photoreceptor drum 3 by electrostatic force can theoretically be employed to determine the transfer efficiency of the transfer process for transferring toner from the photoreceptor drum 3 to the recording sheet by electrostatic force. Taking the fact that the circumferential velocity ratio n between the photoreceptor drum 3 and the transfer belt 61 is about 1 into consideration, the development equation is modified into the equation: $X=(1/?)\{(Vb-Vpo+Vt)/(1/Cp+2/Ct+R)\}$. It is considered from this modified equation that Vb−Vpo should be equal to Vt in order to attain 100% transfer efficiency. The expression 5 is based on Vb−Vpo=Vt.

Here, to attain a transfer efficiency of 85% or more, which is generally considered to ensure a satisfactory condition of image formation without insufficient transfer, reverse transfer and the like, $0.85 \leqq (Vb-Vpo)/Vt \leqq 1.15$ should be satisfied. Since Vb=Vh−Vrp, it follows that $0.85 \leqq (Vh-Vrp-Vpo)/Vt \leqq 1.15$, which consequently gives the above-noted expression 5: $Vh-Vpo-0.85\,Vt \geqq Vrp \geqq Vh-Vpo-1.15\,Vt$. In the inversion phenomenon, $Vpo \approx 0$. It follows that $Vh-0.85\,Vt \geqq Vrp \geqq Vh-1.15\,Vt$.

Figure 14:
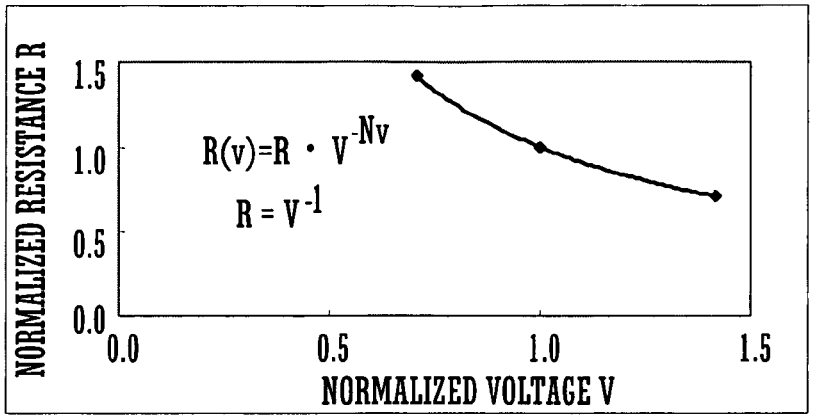
FIG. 14 is a graph showing the current dependence and the voltage dependence of a transfer belt forming the belt transfer apparatus according to the second embodiment of the present invention as well as the relationship between the current dependence coefficient and the voltage dependence coefficient of the transfer belt.
Figure 14:
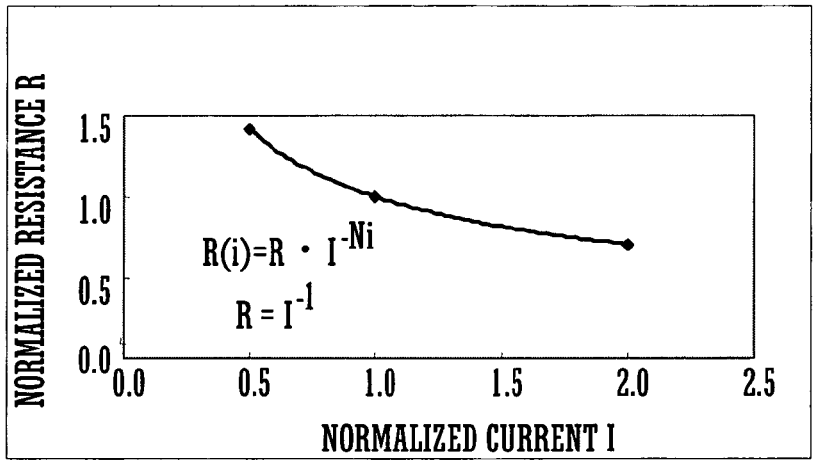
Figure 14:
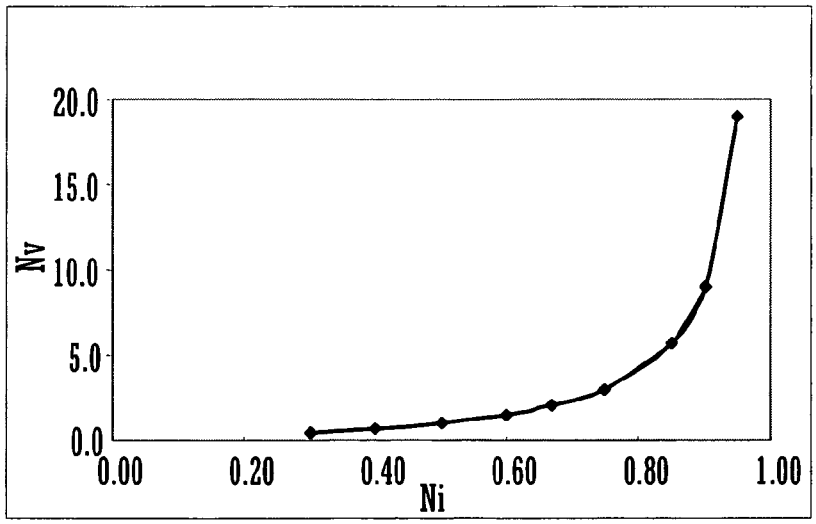

If the resistance of the transfer belt 61 varies proportionally to the minus first power, current dependence R(i) and voltage dependence R(v) of the transfer belt 61 satisfying the above-noted expression 4 are determined as follows:

$$R(i)=R\cdot I^{-Ni}$$

$$R(v)=R\cdot I^{-NV}$$

where R is an initial resistance. FIGS. 14(A) and 14(B) plot voltage dependence R(v) and current dependence R(i), respectively. Here, Ni and Nv are a current dependence coefficient and a voltage dependence coefficient, respectively, which have the following relationship:

$Nv=Ni/(1-Ni)$ when $Ni<1$; and $Nv=1+Ni/(Ni-1)$ when $Ni>1$, as shown in FIG. 14(C).

Figure 15:
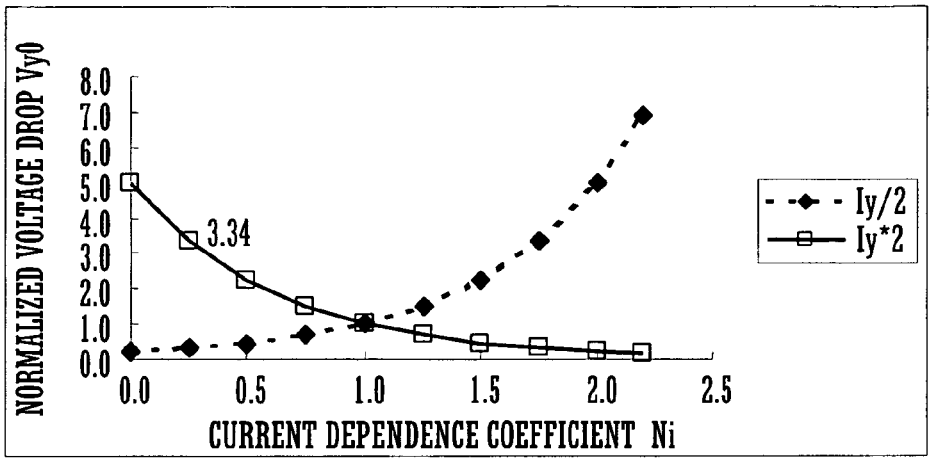
FIG. 15 is a graph showing the influence of the current dependence coefficient upon the voltage drop, the voltage on the reverse side of a recording sheet, and the source voltage.
Figure 15:
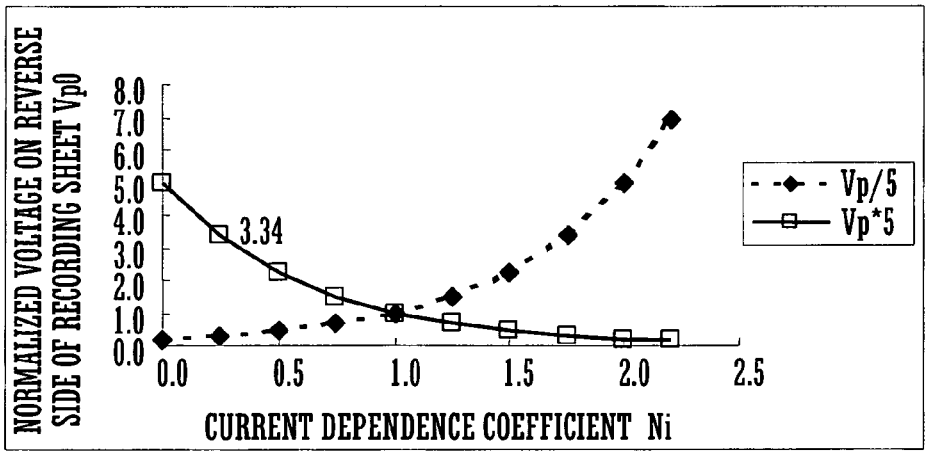
Figure 15:
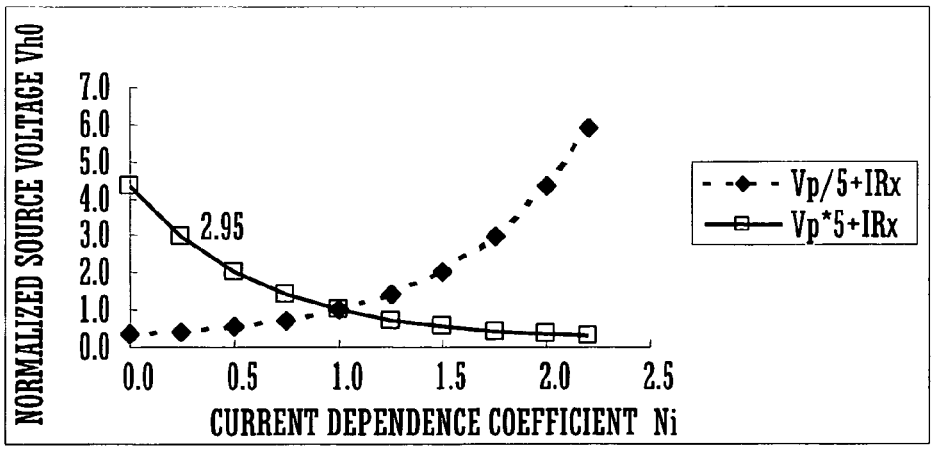

FIG. 15 is a graph showing the influence of the current dependence coefficient upon the voltage drop at the transfer belt, the voltage on the reverse side of the recording sheet, and the source voltage in the above-described belt transfer apparatus.

Assuming that: an established value Iy of current passing through the transfer belt 61 is 1; and normalized voltage drop, normalized current and normalized resistance are Vy0, Iy0 and Ry0, respectively, when a partial current is reduced by half (Iy/2) and when the partial current doubles (Iy×2)

due to partial fluctuations in the impedance of the transfer belt 61, the normalized voltage drop Vy0 at the transfer belt 61 varies with the current dependence coefficient Ni as shown in FIG. 15(A) because:

$$Vy0=Iy0\cdot Ry0;\text{ and}$$

$$Vy=Ry0\cdot(Iy/Iy0)^{-Ni}.$$

Also, assuming that: an established value Vp of voltage applied to the obverse side of the recording sheet 70 is 1; and an established distribution of source voltage from the high-voltage power source 6*f* to the thicknesswise resistance Ry of the transfer belt 61 is 1/S (S=⅕), when an established value of current passing through the lengthwise resistance Rx of the transfer belt 61 is reduced to ⅕ and when the established value of current increases to a 5-times value with variation in the current distribution to the lengthwise resistance Rx and the primary transfer current path 31 due to variation in the impedance of the entire recording sheet 70, the normalized voltage Vp0 on the reverse side of the recording sheet and the normalized source voltage Vh0 vary with the current dependence coefficient Ni as shown in FIGS. 15(B) and 15(*c*) because:

$$Vp0=Ix\cdot Rx0;$$

$$Vp=Rx0\cdot Ix^{-Ni}\cdot Ix;\text{ and}$$

$$Vh=Vp(=Vp+I\text{const}\cdot Ry),\text{ provided } Vy=Vp0/S=I\text{const}\cdot Ry.$$

The current dependence of the thicknesswise resistance Ry of the transfer belt 61 acts effectively on localized current fluctuations slowly following voltage like voltage at the core of the transfer roller 6*b* for example, as shown in FIGS. 15(A) to 15(C), and in this case an optimal value of current dependence coefficient Ni is 1. Also, when the impedance of the primary transfer current path 31 such as the resistance of the recording sheet 70 varies, the current dependence of the lengthwise resistance Rx of the transfer belt 61 acts effectively, and in this case an optimal value of current dependence coefficient Ni is 1. The fact that the current dependence coefficient Ni is 1 is indicative of a constant-voltage characteristic. Such a constant-voltage characteristic can be realized by a Zener diode for example.

Figure 16:
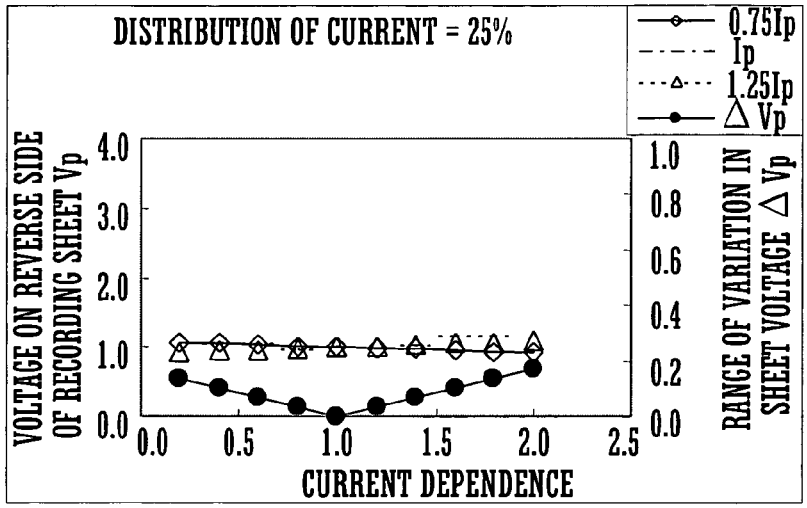
FIG. 16 is a graph showing results of test calculations of the current dependence of the voltage on the reverse side of a recording sheet with fluctuations in the transfer current passing to a primary transfer current path of the belt transfer apparatus.
Figure 16:
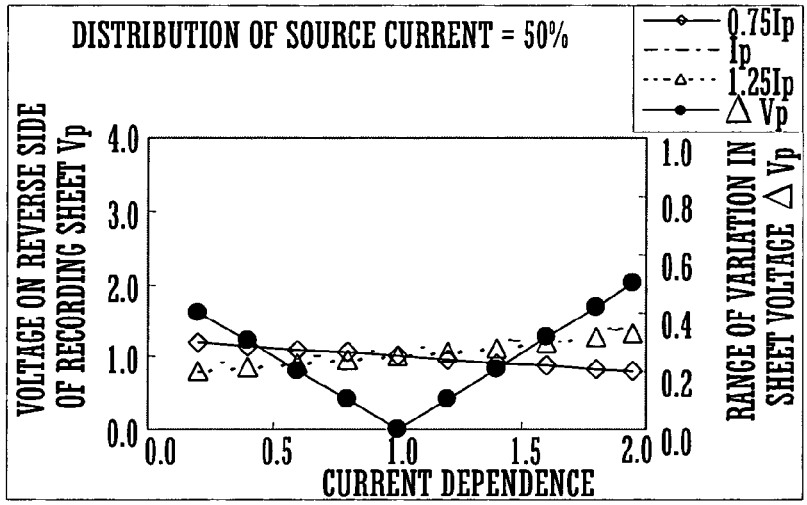
Figure 16:
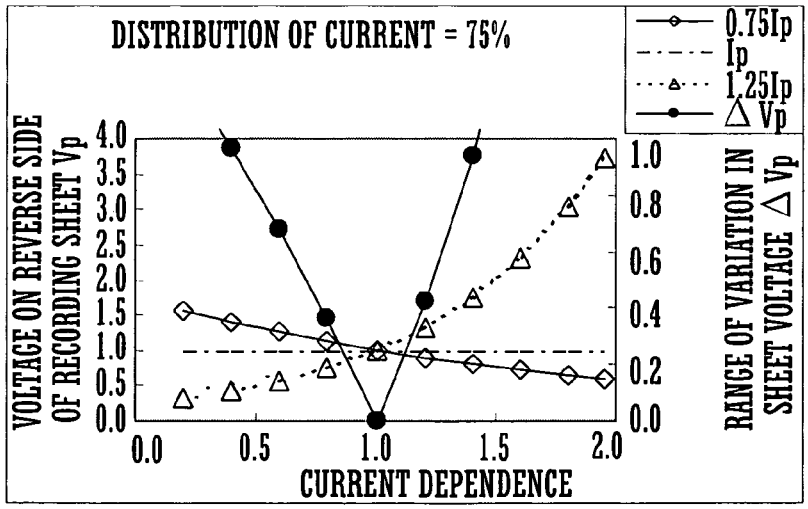

FIG. 16 is a graph showing results of test calculations of the current dependence of the voltage on the reverse side of a recording sheet under the conditions that: a distribution of transfer current to the primary transfer current path 31 of the above-described belt transfer apparatus was set to 25%, 50% and 75%; and an established value of transfer current passing to the primary transfer current path 31 was varied to 75% (25%×75%=19%) and 125% (25%×125%=31%) due to changes in environmental conditions and the like. In FIG. 16, an upper limit is set to 10% of source current on condition that the high-voltage power source 6*f* is a constant-current power source.

Here, impedance Zt of recording sheet 70 in the primary transfer current path 31 is normalized as Zt=Ry0=1.

Also, a distribution ratio ?=Ip/(Ip+Ix) of transfer current to the primary transfer current path 31 is set to 25%, 50% and 75%, and a degree of variation an is set as $a_1$=75%, $a_0$=100%, and $a_2$=125%.

It can be seen that:

$$Ip0=?\cdot I\text{const};$$

$$Ipn=an\cdot ?\cdot I\text{const},\text{ (provided } Ipn<I\text{const});$$

$$Rxn=Rx0\cdot(1-an\cdot ?)^{-Ni};$$

$$Vpn=\{(1-an\cdot ?)\cdot I\text{const}\}\cdot Rxn;\text{ and}$$

$$Vp0=\{(1-?)\cdot I\text{const}\}\cdot Rx0=Ip0\cdot Zt.$$

From the foregoing, it follows that normalized voltage Vpn' on the reverse side of recording sheet, range of variation ?Vp' in the voltage on the reverse side of recording sheet and normalized source voltage are:

$$Vpn'=Vpn/Vp0;$$

$$?Vp'=(Vpn'\text{max}-Vpn'\text{min})/Vp0;\text{ and}$$

$$Vhn=Vpn+I\text{const}\cdot Ry.$$

As can be seen from FIG. 16, the voltage Vp on the reverse side of recording sheet varies depending on the current dependence and the current distribution ratio and the range of variation ?Vp in the voltage on the reverse side of recording sheet assumes the minimum (=0) when the current dependence Ni=1. Also, the range of variation ?Vp in the voltage on the reverse side of recording sheet increases as the current distribution ratio increases (the power source utilization efficiency rises).

Further, according to study on the influence of the current distribution ratio under the condition that the current dependence Ni=0.667, 0.5 and 0.25 (Nv=2.1, 0 and 0.333), the range of variation ?Vp in the voltage on the reverse side of recording sheet increases sharply when the current distribution ratio exceeds 75% and, therefore, the current dependence should be 0.667 or less. The lower limit of the current dependence coefficient is 0.25, or Ni≧0.25, with which voltage drop Vy across the thickness of the transfer belt 61, voltage Vp on the reverse side of recording sheet and current distribution ratio of source voltage Vh are each reduced to ⅔ or less.

The invention claimed is:

1. A belt transfer apparatus, comprising:

a belt-shaped transfer member having contact with a surface of a photoreceptor of an image forming apparatus to sandwich a recording sheet therebetween;

a primary transfer current path on which a current from a high-voltage power source passes through the transfer member and then the photoreceptor; and a secondary transfer current path on which a current from the high-voltage power source passes through the transfer member in a different direction than the primary transfer current path, wherein a voltage drop V1 resulting at the transfer member when a current I1 passes on the primary transfer current path and a voltage drop V2 resulting at the transfer member when a current I2 which is smaller in absolute value than the current I1 passes on the secondary transfer current path, satisfy the expression: |V1/I1|/|V2/I2|<1.

2. The belt transfer apparatus according to claim 1, wherein the voltage drop resulting at the transfer member is substantially constant relative to a variation in the transfer current.

3. The belt transfer apparatus according to claim 1, wherein the high-voltage power source has a constant-current characteristic.

4. The belt transfer apparatus according to claim 1, wherein a second secondary transfer current path is formed to ground the high-voltage power source.

5. An image forming apparatus configured to carry out an electrophotographic image forming process in which an electrostatic latent image formed on a surface of a photoreceptor is developed into a visible toner image, followed by transfer of the toner image from the photoreceptor to a recording sheet, the image forming apparatus comprising a belt transfer apparatus as recited in claim 1.

6. An image forming apparatus configured to carry out an electrophotographic image forming process in which an electrostatic latent image formed on a surface of a photoreceptor is developed into a visible toner image, followed by transfer of the toner image from the photoreceptor to a recording sheet, the image forming apparatus comprising a belt transfer apparatus as recited in claim 2.

7. An image forming apparatus configured to carry out an electrophotographic image forming process in which an electrostatic latent image formed on a surface of a photoreceptor is developed into a visible toner image, followed by transfer of the toner image from the photoreceptor to a recording sheet, the image forming apparatus comprising a belt transfer apparatus as recited in claim 3.

8. An image forming apparatus configured to carry out an electrophotographic image forming process in which an electrostatic latent image formed on a surface of a photoreceptor is developed into a visible toner image, followed by transfer of the toner image from the photoreceptor to a recording sheet, the image forming apparatus comprising a belt transfer apparatus as recited in claim 4.

* * * * *